US007833032B1

(12) United States Patent
Yu

(10) Patent No.: US 7,833,032 B1
(45) Date of Patent: Nov. 16, 2010

(54) AUDIO CONNECTOR

(75) Inventor: Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/562,044

(22) Filed: Sep. 17, 2009

(51) Int. Cl.
*H01R 29/00* (2006.01)

(52) U.S. Cl. ..... 439/188; 439/668

(58) Field of Classification Search ..... 439/188, 439/668; 200/51.1
See application file for complete search history.

(56) References Cited

U.S. PATENT DOCUMENTS 7,108,529 B1 * 9/2006 Huang ..... 439/188

* cited by examiner

*Primary Examiner*—Javaid Nasri
(74) *Attorney, Agent, or Firm*—Cheng-Ju Chiang

(57) ABSTRACT

An audio connector has a base having a center socket. A top of the base has a receiving groove at a side of the socket, and a fixing slot. The receiving groove has a first opening for intercommunicating with the socket. The fixing slot intercommunicates with the receiving groove through a second opening. A resilient switch contact has a resilient arm accommodated in the receiving groove. A free end of the resilient arm is bent to form an arch-like resting end with a slot extending from the beginning to a substantial middle thereof. A connecting piece corresponding to the slot and in alignment with the resilient arm is accordingly formed. A stationary switch contact has a resting arm extending into the receiving groove through the second opening, with a distal end facing the connecting piece for connecting with the connecting piece when the resting end is pressed.

7 Claims, 4 Drawing Sheets

AUDIO CONNECTOR

BACKGROUND OF THE INVENTION

1. Field of the Invention

The present invention relates to an audio connector, and particularly to an audio connector having a set of switch contacts.

2. The Related Art

Referred to U.S. Pat. No. 7,108,529 describes an audio connector having an insulated case, an inner and outer contact and a slide. The insulated case has a central socket, and a first and second inner recess that communicates with the central socket. The second inner recess has a guide channel. The inner contact is mounted in the first inner recess and selectively protrudes into the central socket. The outer contact is mounted in the second inner recess, and has an outer resilient contact, a resilient switch contact and a stationary switch contact. The outer resilient contact selectively protrudes into the central socket. The resilient switch contact has a distal end that aligns with the guide channel and connects with the stationary switch. The slide is mounted movably in the guide channel and is pressed into the central socket by the resilient switch contact. When a plug is inserted into the central socket, the slide is pressed to push the distal end of the resilient switch contact to disconnect from the stationary switch. However, after a long-term use, the resilient switch contact may occur elastic deformation, under the condition of the plug inserted and removed frequently, so that the distal end of the resilient switch contact can not return automatically to connect the stationary switch contact.

SUMMARY OF THE INVENTION

Accordingly, an object of the present invention is to provide an audio connector. The audio connector adapted for receiving a plug has an insulating housing having a base. The base has a center socket for receiving the plug. A top of the base has a receiving groove at a side of the socket, and a fixing slot at a side of the receiving groove opposite to the socket. The receiving groove has a first opening for intercommunicating with the socket. The fixing slot intercommunicates with the receiving groove through a second opening. A resilient switch contact mounted to the insulating housing has a resilient arm accommodated in the receiving groove. A free end of the resilient arm is bent to form an arch-like resting end with a slot extending from the beginning to a substantial middle thereof. A connecting piece corresponding to the slot and in alignment with the resilient arm is accordingly formed. A stationary switch contact fixed in the fixing slot has a resting arm extending slantingly and entering the receiving groove through the second opening, with a distal end facing the connecting piece with a predetermined distance. The resting end projects into the socket through the first opening and is capable of being elastically pressed by the inserted plug to bring the connecting piece to connect with the distal end of the resting arm.

As described above, since the arc-shaped resting end is apart from the connecting piece and projects into the socket. When the plug is inserted into socket, the connecting piece is able to connect with the distal end under the condition of the resilient arm extruded to move a short distance. Such connection structure reduces the deformation of the resilient arm and prolongs the use lift of the resilient switch contact.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
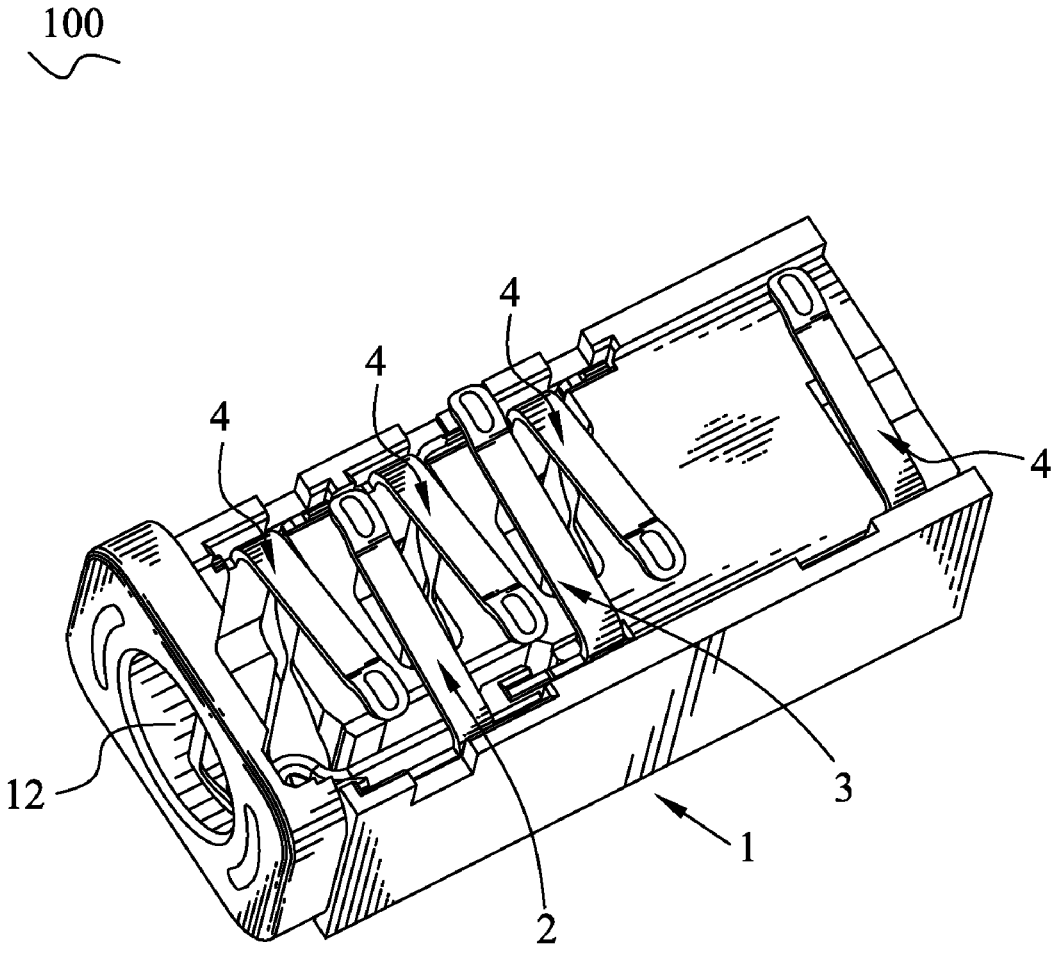
FIG. 1 is an assembled, perspective view of an audio connector of an embodiment in accordance with the present invention.
Figure 2:
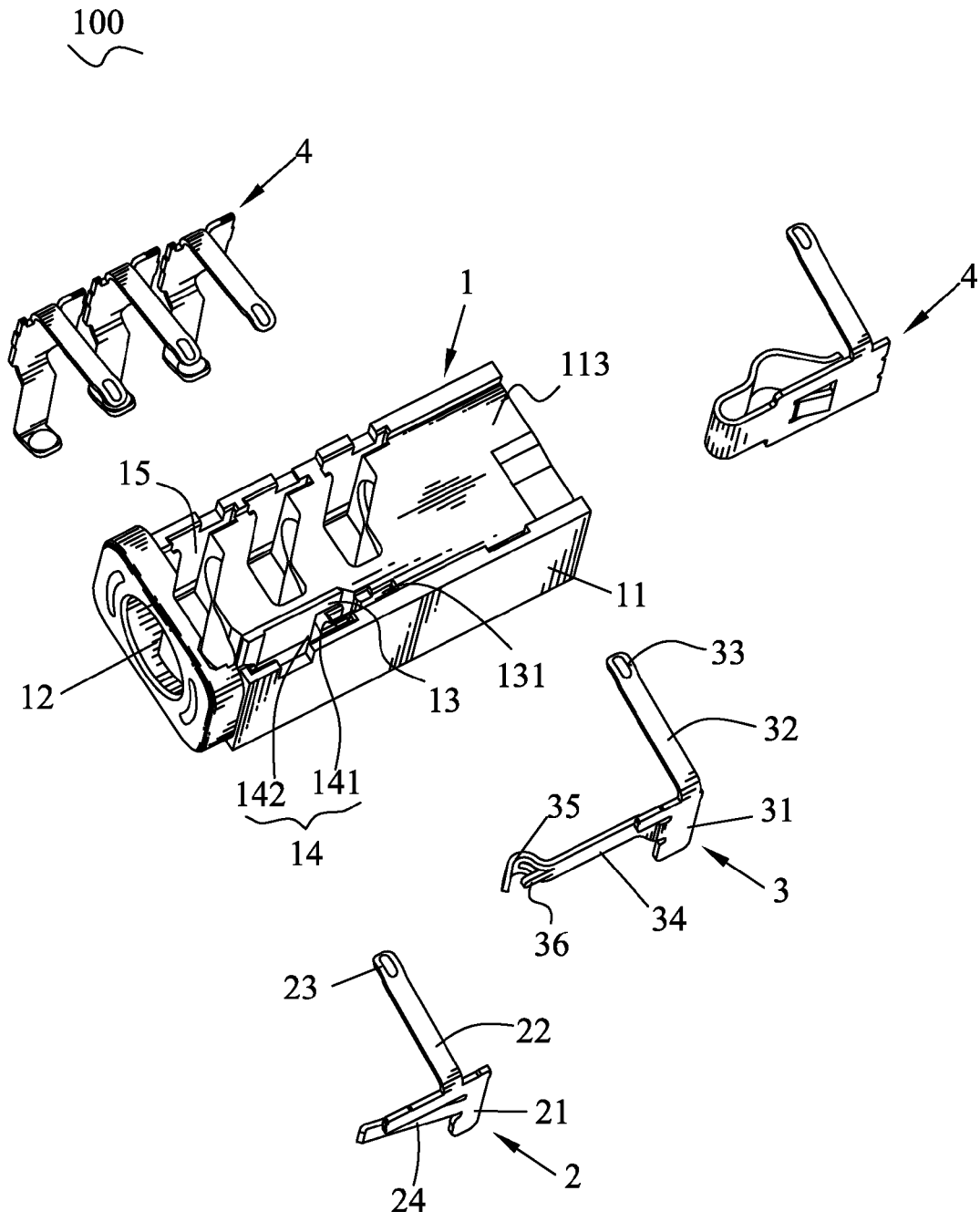
FIG. 2 is an exploded, perspective view of the audio connector shown in FIG. 1.

Referring to the drawings in greater detail, and first to FIGS. 1-2, the embodiment of the invention is embodied in an audio connector 100. The audio connector 100 comprises an insulating housing 1, a stationary switch contact 2, a resilient switch contact 3, and a plurality of conductive terminals 4.

Figure 3:
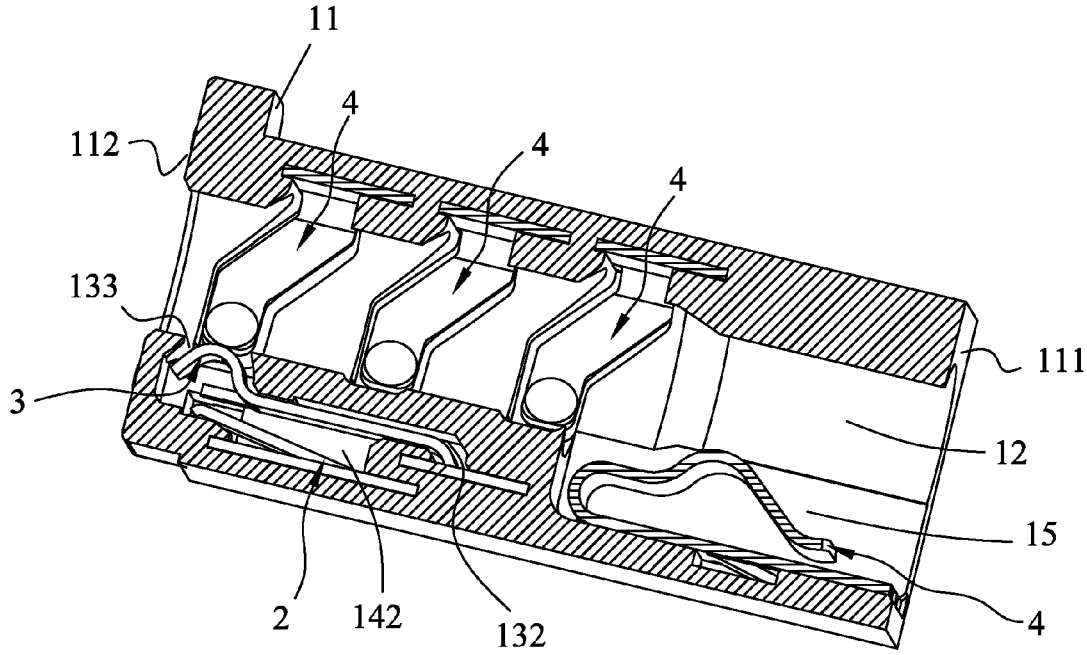
FIG. 3 is a cross-sectional view of the audio connector shown in FIG. 1.

Referring to FIGS. 2-3, the insulating housing 1 has a substantially rectangular base 11. The base 11 defines an inner end 111 and an outer end 112 which is opposite to the inner end 111 and firstly contacts an inserted plug (not shown), and has a central socket 12. The socket 12 extends along a lengthways direction of the base 11 and passes through the inner end 111 and the outer end 112 for accommodating the plug. A top surface 113 of the base 11 has a first groove 13 for receiving the resilient switch contact 3, a second groove 14 communicating with the first groove 13 for receiving the stationary switch contact 2, and a plurality of third grooves 15 for receiving the conductive terminals 4. The first groove 13 is arranged adjacent to the outer end 112 and has a first fixing slot 131, which extends parallel to the extending direction of the socket 12 and is located at a side of the socket 12, and a receiving groove 132, which extends parallel to the extending direction of the socket 12 and is closer to the socket 12 than the first fixing slot 131. An end of a side of the receiving groove 132 has a first opening 133 adjacent to the outer end 112 and communicating with the socket 12. An opposite side of the receiving groove 132 has an end away from the outer end 112 communicating with the first fixing slot 131. The second groove 14 is disposed at a side of the receiving groove 132 opposite to the socket 12, and has a second fixing slot 141 parallel to the receiving groove 132, with a second opening 142 formed at a substantially middle of a side thereof for intercommunicating with the receiving groove 132. In this embodiment, the first groove 13 and the second groove 14 are both located at one end of one side of the socket 12, adjacent to the outer end 112. One third groove 15 is formed at the other end of the side of the socket 12, and three third grooves 15 are formed at the opposite side of the socket 12.

Figure 4:
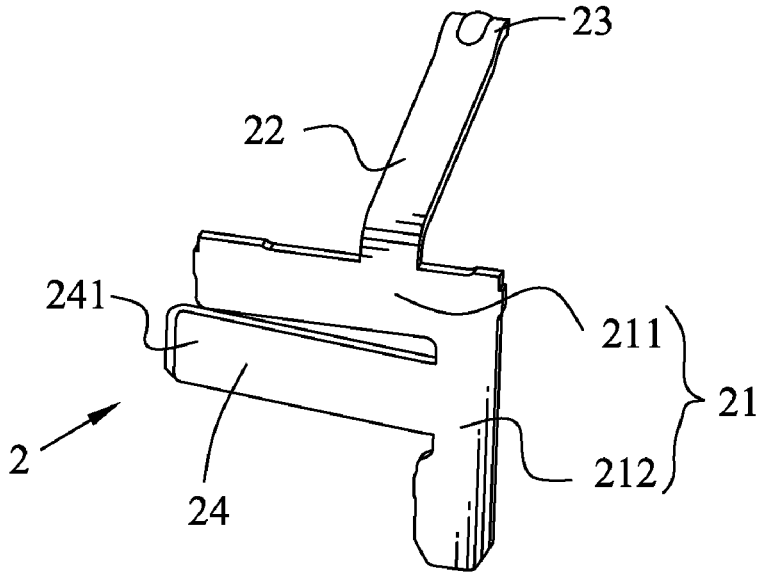
FIG. 4 is a perspective view of a stationary switch contact of the audio connector shown in FIG. 2.

With reference to FIG. 2 and FIG. 4, the stationary switch contact 2 has a fixing slice 21, a contacting arm 22 and a resting arm 24. The fixing slice 21 has a first section 211 and a second section 212 extended perpendicularly and downwardly from an end of a side thereof, forming an inverted-L shape. A side of the first section 211 opposite to the second section 212 is extended obliquely and upwardly to form the contacting arm 22. The contacting arm 22 and the resting arm 24 are strip shape. A free end of the contacting arm 22 is arched to form a contacting end 23. The resting arm 24 is extended obliquely towards a same side as the contacting arm 22 with respect to the first section 211 from a side of the second section 212 where the first section 211 is connected, with a distal end 241 bent oppositely. The first section 211 and the resting arm 24 cooperatively form an acute angle.

Figure 5:
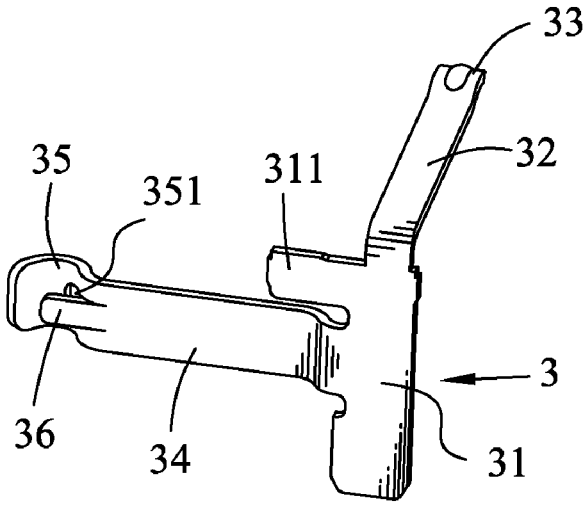
FIG. 5 is a perspective view of a resilient switch contact of the audio connector shown in FIG. 2.

Referring to FIG. 2 and FIG. 5, the resilient switch contact 3 has a rectangular holding slice 31, a contacting arm 32 extended slantingly and upwardly from a short side of the holding slice 31, and a resilient arm 34 extended outwards from a substantially middle of a long side of the holding slice 31. In this embodiment, the holding slice 31 further has a buckling slice 311 which is extended outwards from an upper end of the long side of the holding slice 31, adjacent to the contacting arm 32. The resilient arm 34 slants towards a same side as the contacting arm 32 with respect to the holding slice 31, and stretches in a way parallel to the buckling slice 311. A distal end of the resilient arm 34 is bent to form an arch-like resting end 35, with a slot 351 extending from the beginning to a substantial middle thereof. A connecting piece 36 corresponding to the slot 351 and in alignment with the resilient arm 34 is accordingly formed. In this embodiment, the connecting piece 36 may be manufactured by means of punching process. The contacting arm 32 is analogue to the contacting arm 22, having a contacting end 33. The contacting arm 32 and the resilient arm 34 are both in a strip shape.

With reference to FIGS. 1-3, the resilient switch contact 3 is mounted to the first groove 13. The holding slice 31 is inserted into the first fixing slot 131. The resilient arm 34 is disposed in the receiving groove 132, with the resting end 35 projecting into the socket 12 through the first opening 133. The stationary switch contact 2 is assembled in the second groove 14. The fixing slice 21 is fixed into the second fixing slot 141. The resting arm 24 extends slantingly into the receiving groove 132 through the second opening 142, with the distal end 241 facing the connecting piece 36 of the resilient switch contact 3 with a short distance. The contacting arms 22, 32 are both disposed above the top surface 113 of the base 11.

When the plug is inserted into the socket 12 and deflects the resting end 35 elastically, the connecting piece 36, correspondingly, is moved to connect with the distal end 241 of the resting arm 24, thereby achieving the electrical connection between the stationary switch contact 2 and the resilient switch contact 3. When the plug is removed from the socket 12, the resting end 35 returns an original position automatically. The connecting piece 36 is brought to disconnect the distal end 241 of the resting arm 24.

As described above, since the arc-shaped resting end 35 is apart from the connecting piece 36 and projects into the socket 12. When the plug is inserted into socket 12, the connecting piece 36 is able to connect with the distal end 241 under the condition of the resilient arm 34 extruded to move a short distance. Such connection structure reduces the deformation of the resilient arm 34 and prolongs the use lift of the resilient switch contact 3. Furthermore, the stationary switch contact 2 and the resilient switch contact 3 are simple and compact, which are easy to manufacture and convenient to assemble.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio connector adapted for receiving a plug, comprising:

an insulating housing having a base, the base having a center socket for receiving the plug, a top of the base having a receiving groove at a side of the socket, and a fixing slot at a side of the receiving groove opposite to the socket, the receiving groove having a first opening for intercommunicating with the socket, the fixing slot intercommunicating with the receiving groove through a second opening;

a resilient switch contact mounted to the insulating housing, and having a resilient arm accommodated in the receiving groove, a free end of the resilient arm being bent to form an arch-like resting end, with a slot extending from a beginning to a substantial middle thereof, a connecting piece corresponding to the slot and in alignment with the resilient arm being accordingly formed; and a stationary switch contact fixed in the fixing slot and having a resting arm extending slantingly and entering the receiving groove through the second opening, with a distal end facing the connecting piece with a predetermined distance;

wherein the resting end projects into the socket through the first opening and is capable of being elastically pressed by the inserted plug to bring the connecting piece to connect with the distal end of the resting arm.

2. The audio connector as claimed in claim 1, wherein the resilient switch contact has a rectangular holding slice fixed in the base, a contacting arm is extended slantingly and upwardly from a short side of the holding slice and located above the top surface of the base, the resilient arm is extended outwards from a long side of the holding slice.

3. The audio connector as claimed in claim 2, wherein the resilient arm slants towards a same side as the contacting arm with respect to the holding slice, and stretches parallel to the holding slice.

4. The audio connector as claimed in claim 2, wherein the base has another fixing slot located at the side of the receiving groove opposite to the socket same as the fixing slot for fixing the stationary switch contact therein, the another fixing slot is parallel to the receiving groove and communicates with the receiving groove for receiving the holding slice.

5. The audio connector as claimed in claim 1, wherein the stationary switch contact has a fixing slice mounted in the fixing slot, the fixing slice has a first section and a second section extended perpendicularly from an end of a side of the first section, forming an L shape, the resting arm is extended outwards from a side of the second section where the first section is connected.

6. The audio connector as claimed in claim 5, wherein a side of the first section opposite to the second section is extended obliquely to form a contacting arm located above the top surface of the base, the resting arm is extended obliquely towards a same side as the contacting arm with respect to the first section, forming an acute angle therebetween.

7. The audio connector as claimed in claim 1, wherein the resilient arm and the resting arm are strip shape.

* * * * *